US012258861B2

(12) United States Patent
Merzhäuser

(10) Patent No.: US 12,258,861 B2
(45) Date of Patent: Mar. 25, 2025

(54) DEVICE FOR GENERATING OSCILLATIONS FOR A CONSTRUCTION MACHINE AND METHOD OF OPERATION

(71) Applicant: EURODRILL GmbH, Drolshagen (DE)

(72) Inventor: Markus Merzhäuser, Drolshagen (DE)

(73) Assignee: EURODRILL GmbH, Drolshagen (DE)

( * ) Notice: Subject to any disclaimer, the term of this patent is extended or adjusted under 35 U.S.C. 154(b) by 0 days.

(21) Appl. No.: 18/641,956

(22) Filed: Apr. 22, 2024

(65) Prior Publication Data

US 2024/0352797 A1 Oct. 24, 2024

(30) Foreign Application Priority Data

Apr. 24, 2023 (EP) ..... 23169574

(51) Int. Cl.
*E21B 6/08* (2006.01)

(52) U.S. Cl.
CPC ..... *E21B 6/08* (2013.01)

(58) Field of Classification Search
CPC ..... E21B 6/08
See application file for complete search history.

(56) References Cited

U.S. PATENT DOCUMENTS 2,948,059 A * 8/1960 Bodine, Jr. ..... E21B 31/005 175/56
3,371,726 A * 3/1968 Bouyoucos ..... E21B 6/00 173/207

(Continued)

FOREIGN PATENT DOCUMENTS

DE 30 388 35 A1 4/1981
EP 1 728 564 B1 4/2010

(Continued)

OTHER PUBLICATIONS

The extended European search report issued by the European Patent Office on Oct. 16, 2023, which corresponds to European Patent Application No. EP 23169574.3-1002.

*Primary Examiner* — Shane Bomar
(74) *Attorney, Agent, or Firm* — Studebaker Brackett PLLC

(57) ABSTRACT

The invention relates to a device for generating oscillations for a construction machine, comprising a housing, a piston which is movable back and forth in a working chamber in the housing between a first return point and a second return point, a pressurized fluid supply through which in each case pressurized fluid can be fed into and discharged from the working chamber via at least one actuatable control valve in the region of the first return point and the second return point, wherein the piston can be induced into a reciprocating motion in order to generate the oscillations, and a control unit which is configured to actuate the at least one control valve and by means of which the movement of the piston in the working chamber is controllable and variable. According to the invention, it is provided that the control unit is configured to control the piston in a first operating mode for generating oscillations and in a second operating mode for generating impact pulses, wherein a strike surface is formed on at least one end side of the working chamber, onto which surface the piston strikes when it reaches at least one return point in order to generate an impact pulse.

15 Claims, 2 Drawing Sheets

(56) References Cited

U.S. PATENT DOCUMENTS

Figure 1:
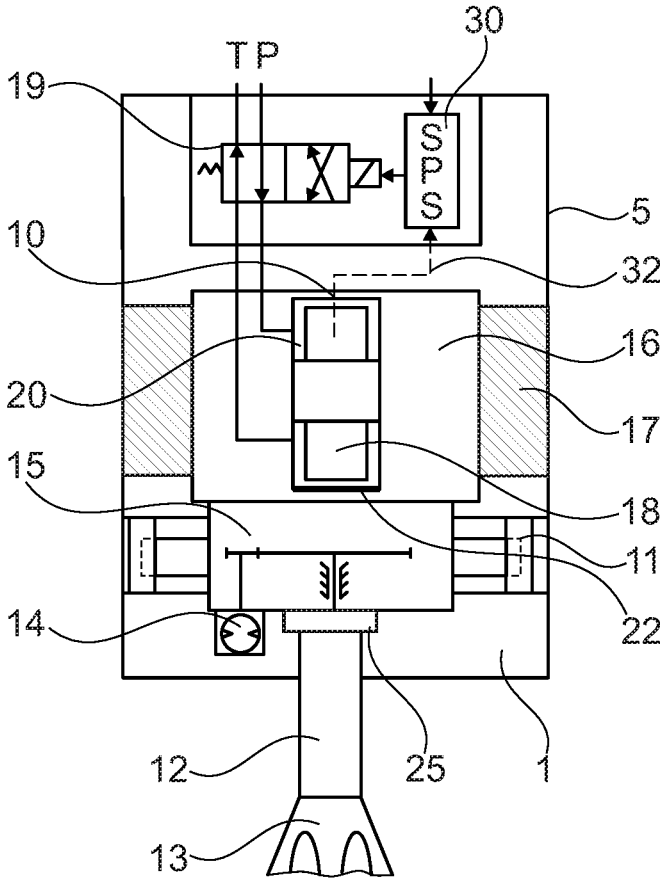

| | | | | |
|---|---|---|---|---|
| 4,026,193 | A | 5/1977 | Olmsted | |
| 4,031,812 | A | 6/1977 | Koshelev | |
| 4,342,255 | A | 8/1982 | Watanabe et al. | |
| 4,646,854 | A * | 3/1987 | Arndt | B25D 9/145 91/321 |
| 7,404,449 | B2 * | 7/2008 | Bermingham | E02D 13/06 173/128 |
| 11,072,977 | B2 * | 7/2021 | Koizumi | E21B 1/00 |
| 2010/0051348 | A1 * | 3/2010 | Andersson | B25D 17/245 175/57 |
| 2016/0103235 | A1 * | 4/2016 | Shampine | G01V 1/44 367/143 |
| 2018/0361432 | A1 * | 12/2018 | Merzhaeuser | B06B 1/18 |

FOREIGN PATENT DOCUMENTS

| | | | |
|---|---|---|---|
| EP | 3 417 951 | A1 | 12/2018 |
| EP | 4 001 510 | A1 | 5/2022 |
| GB | 920158 | A | 3/1963 |

* cited by examiner

DEVICE FOR GENERATING OSCILLATIONS FOR A CONSTRUCTION MACHINE AND METHOD OF OPERATION

The invention relates to a device for generating oscillations for a construction machine, comprising a housing, a piston which is movable back and forth between a first return point and a second return point in a working chamber in the housing, a pressurized fluid supply through which pressurized fluid can be fed into and discharged from the working chamber via at least one actuatable control valve in the region of the first return point and/or the second return point, wherein the piston can be set into a reciprocating motion in order to generate the oscillations, and a control unit, which is configured to actuate the at least one control valve and by means of which the movement of the piston in the working chamber is controllable and variable, according to the preamble of claim 1.

The invention further relates to a method of operating a device, in which a piston in a working chamber is moved back and forth in a reversing manner between a first return point and a second return point, wherein the piston is set into a reciprocating motion by means of a pressurized fluid and at least one actuatable control valve in order to generate the oscillations, and the pressurized fluid is introduced into and discharged from the working chamber in the region of the first return point and/or the second return point, and the at least one control valve is actuated by means of a control unit, wherein the movement of the piston in the working chamber is controllable and variable, according to the preamble of claim 12.

EP 1 728 564 B1 discloses an oscillation generator for a construction machine. In this known oscillation generator, the working chamber in the housing is divided into two pressure chambers by a working piston. The two pressure chambers are selectively supplied with a pressure fluid via an inlet and an outlet in a targeted manner, so that the working piston moves in a reversing manner and generates an oscillation. The timed supply and discharge of pressurized fluid into the individual pressure chambers is effected via a complex duct assembly in the working piston. In addition, a control piston is still slidably mounted inside the working piston, which can selectively change its position relative to the working piston by means of stops that project from the end faces of the housing in order to open or close certain channels. Supply and discharge of pressurized fluid is thus achieved by mechanical means, with the pressurized fluid supply and discharge being switched when certain switchover points are reached by the predetermined channels.

Comparable mechanical control devices for oscillation generators can also be found in GB-A-920,158, U.S. Pat. Nos. 4,026,193 or 4,031,812, for example. All of these known devices comprise a working piston and a control piston which open or close certain channels depending on the respective position in the housing, thereby effecting a targeted alternating supply of the two opposite pressure chambers for moving the working piston.

From DE 30 388 35 A1 or EP 3 417 951 A1 is known a generic oscillation generator with a control unit for controlling a control valve. In EP 3 417 951 A1, which comes from the applicant, it is taught that such a control unit can be used in an oscillation generator or in a percussion mechanism.

The object underlying the invention is to provide a device and a method for generating oscillations which can be used particularly efficiently, in particular on a construction machine.

The object is achieved, on the one hand, by means of a device having the features of claim 1 and, on the other hand, by means of a method having the features of claim 12. Preferred embodiments of the invention are specified in the dependent claims.

The device according to the invention is characterized in that the control unit is configured to actuate the piston in a first operating mode for generating oscillations and in a second operating mode for generating impact pulses, wherein a strike surface is formed on at least one end side of the working chamber, onto which surface the working piston strikes when it reaches at least one return point in order to generate an impact pulse.

A basic idea of the invention is to provide a device which is configured both for generating oscillations and for generating impact pulses. For this purpose, a strike surface is formed on at least one end side of the working chamber. The piston is also provided with a corresponding strike surface and is configured for generating impact pulses. Preferably, the working chamber may comprise two opposite end faces, each of which is formed with a strike surface. Accordingly, the piston can also be provided with two corresponding strike surfaces. The strike surface can preferably be hardened in relation to the adjacent wall surfaces.

According to one aspect of the invention, the control unit is configured such that it is provided or configured with a control program with a first operating mode for generating oscillations and with a second operating mode for generating impact pulses. In the first operating mode, the piston in the working chamber is controlled in such a way that the piston does not strike against an end or a front side of the working chamber during its reciprocating motion. The reciprocating motion of the piston thus generates an oscillation without impact pulses. The device forms a so-called linear oscillator.

In the second operating mode, on the other hand, the at least one control valve is actuated in such a way that the piston strikes in a defined manner onto at least one end side of the working chamber, in particular onto the side facing the ground in the case of a drilling rig and thereby generating a targeted impact pulse.

The device can thus be used and operated alternately and depending on the operating mode selected either as a linear oscillator without impact pulses or as a percussion mechanism along with the generation of targeted impact pulses.

In principle, all suitable actuatable valves can be used for the device according to the invention, in particular which are hydraulically or electrically actuatable. According to a further development of the invention, it is particularly expedient for the control valve to be configured as a solenoid valve. The valve body can be adjusted between an open and a closed position by means of an electromagnetic assembly. In this case, intermediate positions can also be set so that the amount of pressurized fluid fed into the working chamber can be adjusted. In principle, any pressurized fluid can be provided, wherein hydraulic oil is preferably used.

Another preferred configuration is that a measuring device is provided for determining a position of the piston in the working chamber. This enables very precise control of the piston, wherein the measuring device communicates with the control unit.

Also in regard to the measuring device, this can also be equipped with all usable sensors for length or position measurement, which in particular operate optically, capacitively, inductively, magnetically or in any other way. According to one embodiment of the invention, it is particularly advantageous for the measuring device to have a linear sensor. This is particularly useful if the piston is moved linearly in the housing between the two return points.

Further, it can be provided that the measuring device comprises an elongated first measuring component that extends into the working chamber and into a free space in the piston. This means that the measuring component is not located behind a wall of the housing, but directly in the working chamber in which the piston moves. For a particularly accurate position measurement, here the elongated first measuring component extends into a corresponding free space in the piston, wherein the piston preferably sliding along the first measuring component in a non-contact manner.

According to a further variant of the invention, it is preferred that a frequency and/or a stroke of the piston can be set and adjusted by means of the control unit. To change the frequency, in particular the opening and closing time points and, if necessary, the supply of hydraulic energy is adjustable by means of the control unit. The stroke of the piston can also be achieved by changing the position of the two return points by opening and closing the actuatable valves accordingly. For this purpose, the control unit preferably comprises an input interface such as an input control panel. The control unit can also be actuated accordingly by means of an operating unit using a known machine controller directly by an operator.

A further preferred embodiment variant of the invention can be seen in the fact that the control unit comprises a program memory in which various control programs for controlling the piston can be stored. In this way, special-control programs can be stored for certain application purposes. In particular, a control program can be stored with the two operating modes. Furthermore, a high frequency with a small piston stroke can be provided at the start of a program, for example, while the piston stroke increases and a frequency decreases as the program flows over time. Almost any number of different program sequences can be provided to control the piston in terms of frequency and stroke. For example, a program can be provided for fast propulsion or for a particularly gentle driving-into. Programs for special soil types can also be stored when operating as a construction machine.

Furthermore, an advantageous embodiment can be achieved in that the control unit comprises a selection device by means of which an operating mode can be selected manually by an operator and/or automatically on the basis of a detected operating state. For example, an operator can manually switch between the first operating mode for generating oscillations and the second operating mode for generating impact pulses. The selection device can be part of an operating unit. Alternatively or additionally, the control unit can also automatically initiate a switching of the operating modes, for example if certain operating states of a machine, on which the device according to the invention is arranged, are present.

According to a further embodiment of the invention, it is preferred that the working chamber is formed with two end sides, each having one strike surface onto which the working piston alternately strikes, in order to generate impact pulses. Accordingly, the piston can also be provided with two corresponding strike surfaces.

The invention comprises a construction machine which is characterized in that the device described above is arranged, in order to generate oscillations and impact pulses. In particular, the construction machine can be provided and configured for civil engineering.

According to one embodiment of the invention, it is particularly advantageous that the construction machine is configured as a drilling rig for drilling earth and/or rock. The drilling rig comprises a rotary drive for rotationally driving drill pipes and/or drilling tool. The device according to the invention can be arranged on the rotary drive or combined therewith.

If the device is operated free of impact contacts to generate oscillations in accordance with the first operating mode, so-called overburden drilling can be carried out, in particular. In this case, the rotary movement of the drilling tool is superimposed by a vibration or oscillating movement. Superimposed oscillations can achieve a quasi-liquefaction of the soil, at least in the contact area with the drilling tool, which leads to improved drilling progress. The application of oscillations can also make it easier to pull the drilling tool out of a borehole.

If the device for generating impact pulses is operated in accordance with the second operating mode, impact drilling can be carried out. This is particularly advantageous when breaking through harder rock layers.

It is also particularly preferred that the device for generating oscillations and impact pulses is arranged on a rotary drive for rotationally driving a drilling tool and that a damping element is arranged between the rotary drive and the drilling tool or drill pipes. The damping element, which may comprise a disk spring assembly, for example, can help to protect the rotary drive, wherein oscillations or impacts exerted by the device onto the drilling tool or a drill pipe cannot be transmitted to the rotary drive, or can be transmitted in a damped manner. The damping element can be configured to transmit torque between the rotary drive and the drilling tool or drill pipes. To protect the damping element it can be useful in particular for the control unit to switch from an operating mode for generating impact pulses to an operating mode for generating oscillations when a drilling tool is pulled.

The method according to the invention is characterized in that the control unit is configured to control the piston in a first operating mode for generating oscillations and in a second operating mode for generating impact pulses, wherein a strike surface is formed on at least one end side of the working chamber, onto which the working piston strikes when it reaches at least one return point in the second operating mode in order to generate an impact pulse.

The method according to the invention can be carried out in particular by means of the device described above. This results in the advantages described above.

The method according to the invention is preferably developed in that an operating mode is selected and set by means of a selection device. The selection can take place manually by an operator or automatically by a program of the control unit depending on an operating state. Depending on the selection of the operating mode, the actuation of the at least one control valve is changed by the control unit so that oscillations are generated without an impact contact according to the first operating mode or impact pulses are generated according to the second operating mode.

According to a further development of the method it is also preferred that the device for generating oscillations and impact pulses is used on a drilling rig with a drilling tool which can be driven in rotation, that the device is operated in the second operating mode during a sinking-by-drilling of a borehole into soil or rock, wherein impact pulses are exerted on the drilling tool, and that when the drilling tool is pulled out of the borehole, the device is operated in the first operating mode, wherein the drilling tool is induced to oscillate.

The method constitutes a drilling method in which a drilling tool is driven in rotation with or without drill pipes. Depending on the state of the drilling process, the rotary movement is superimposed with oscillations or impact pulses. In particular like this, impact drilling can be carried out during a sinking-by-drilling operation, in which the rotary movement is combined with impact pulses in accordance with the second operating state. For efficient retraction of the drilling tool from the drill hole, the device is switched to the first operating mode for generating oscillations without impact pulses. Axial oscillation of the drilling tool during pulling reduces friction effects, so that overall pulling is easier and also gentler on the borehole wall and a damping element possibly provided. The oscillation can be effected with or without a rotation of the drilling tool. The rotation can also preferably be performed as a reversing rotary movement during pulling.

A particularly preferred embodiment variant of the invention is that an operating state, in particular sinking-by-drilling or pulling of a drilling tool in a drilling rig, is detected by means of at least one detection device and that an operating mode is automatically selected and set by means of the selection device depending on the detected operating state. In particular, the detection device can detect whether sinking-by-drilling, i.e. advancement in the drilling direction, or pulling, i.e. a retraction movement from a borehole, occurs. Depending on this operating state, automatic switching between the two operating modes can then take place, in particular switching from generating impact pulses during sinking-by-drilling according to the second operating mode for generating oscillations according to the first operating mode, when pulling the drilling tool.

The detection device can preferably also detect an advancing movement and/or a rotational speed and/or a torque of the drilling tool, wherein the control unit is configured to draw a conclusion about an in-situ soil layer based on this. For example, a reduction in the rotational speed and the rate of advance or an increase in the torque can be an indication that a more firm soil layer is in-situ. In such a case, the control unit can automatically switch to the second operating mode of the device in order to generate impact pulses.

If, on the other hand, a softer soil layer is detected, the control unit can switch the device to the first operating mode to perform overburden drilling with oscillations. As an alternative to automatic switching over, the control unit can also give or display a message or recommendation to a machine operator via the operating unit to change the operating mode. During sinking-by-drilling, it is generally possible to select whether oscillations or impact pulses are to be generated. When pulling, oscillations are generated in any case with the device according to the invention.

Figure 2:
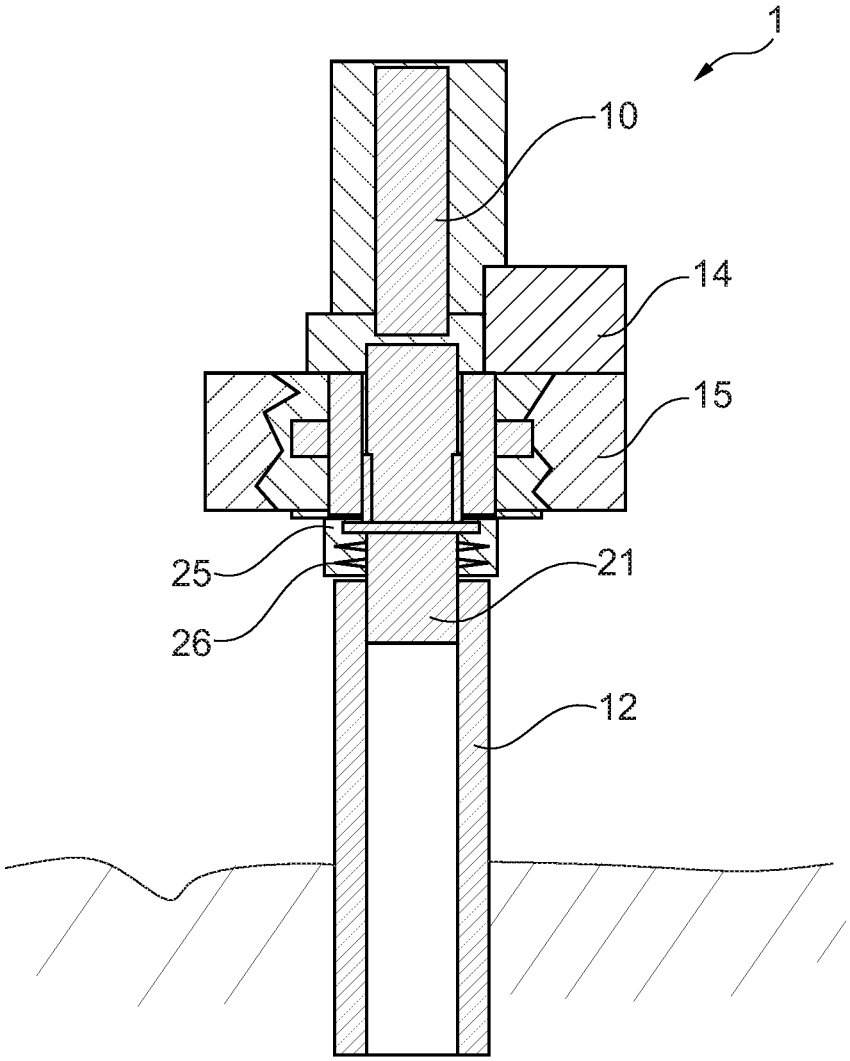

The invention is explained further with reference to preferred exemplary embodiments, which are shown schematically in the drawings. The drawings show in:

FIG. 1 a schematic cross-sectional view of a device according to the invention, and FIG. 2 another schematic cross-sectional view of a device according to the invention.

FIG. 1 schematically shows a drill drive assembly 1 for a drilling rig, which assembly is equipped with a device 10 according to the invention for generating oscillations and impact pulses. The drive assembly 1 may comprise an enclosure 5 that can accommodate all functional components. A drill pipe 12, which can carry a drilling tool 13 at its distal end, protrudes from the enclosure 5. The drill pipe 12 can be set into a rotary motion about the axis of the drill pipe 12 by means of a drive 14, such as a hydraulic motor, via a transmission 15. The drive 14 and the transmission 15 may form a so-called drill drive.

A damping element 25 can be arranged between the drill drive and the drill pipe 12 in order to dampen oscillations and shocks being transmitted to the drill drive. A cutting edge of the drilling tool 13 can remove material at the bottom of the hole by means of the rotary movement of the drilling tool 13.

In accordance with the invention, the device 10 is mounted on the transmission 15 with a housing 16, which is essentially configured to generate oscillations and impact pulses. The housing 16 can be mounted via rubber elements 17 which dampen the transmission of the generated vibrations from the housing 16 towards the enclosure 5. The drill drive can be displaceably mounted in an axial guide 11. Furthermore, the transmission 15 can be operated in a manner decoupled from the vibration generation of the device 10. In this case, in an exemplary manner, the vibration generated can be transmitted directly to the drill pipes 12 and thus to the drilling tool 13 via a shaft, which shaft can be led through an output shaft configured as a hollow shaft. The rotary motion generated by the transmission 15 can be transmitted from the hollow shaft to the drill pipes 12 and thus to the drilling tool 13 via a toothing or any tooth profile that decouples the generated axial vibration from the transmission. The damping element 25 provides for an additional vibration decoupling. Alternatively, the shaft can also transmit the rotary motion and a hollow shaft the generated vibration.

The device 10 comprises a piston 18 which is displaceably mounted in a working chamber 20 of the housing 16, wherein the piston 18 divides the working chamber 20 into two pressure chambers. These pressure chambers in the working chamber 20 can be alternately supplied with a pressurized fluid, in particular a hydraulic fluid, via a pressurized medium supply. The pressurized fluid can be provided in a pressurized fluid line P and alternately fed into and discharge from the pressure chambers on either side of the piston 18 by means of a control valve 19.

The control valve 19 can, for example, be an electromagnetically actuated 2/4-way valve. However, any other appropriate valves can also be used, e.g. with rotating valve spools, proportional valves and/or servo valves. The respectively non-pressurized chamber on the piston 18 can be alternately connected to a pressure-less tank line T via the control valve 19. This alternating pressurization of the piston 18 causes it to be induced to a reversing motion between two return points in the working chamber 20.

A position of the return points and a frequency of the piston 18 can be controlled and set via the control valve 19 by a control unit 30, in particular with a memory programmable logic control (MPLC).

The current position of the piston 18 can be detected and transmitted to the control unit 30 via a measuring device 32 on the working chamber 20, which is not shown in detail. The actual stroke and the frequency of the piston 18 can also be determined, checked and set as variables derived from this.

In particular, a first control program for carrying out a first operating mode and a second control program for carrying out a second operating mode are stored in the control unit 30. In the first operating mode, the control unit 30 actuates the control valve 19 in such a way that the piston 18 is moved back and forth without contact with the two end faces of the working chamber 20. In this way, an oscillation can be generated in the first operating mode without a strike contact.

If the second operating mode is set on the control unit 30 via a selection device (not shown in greater detail), the pressure medium supply takes place via the control valve 19 in such a way that the piston 18 strikes in a contacting manner at least against the lower end side of the working chamber 20, which is configured as a strike surface 22, in order to generate impact pulses. In this way, impact pulses can be transmitted to the drill pipes 12 and the drilling tool 13 during drilling.

FIG. 2 shows a further drive assembly 1 according to the invention for a drilling rig, in particular for earth or rock drilling with the device 10 according to the invention, wherein mainly a connection of drill pipes 12 with the drill drive and the device is illustrated. A torque is transmitted by a drive 14, which is only schematically indicated, via a transmission 15 with a hollow output element to a so-called insertion element 21. The insertion element 21 is connected to the tubular drill pipes 12 in an axially displaceable but in a torque proof manner. On a top side of the insertion element 21, oscillation or impact pulses can be transmitted to the insertion element 21 and thus to the drill pipe 12 via the device 10, which is only indicated schematically.

The insertion element 21 is axially displaceable in the hollow output element of the transmission 15, but is arranged in a torque proof manner, for example via suitable spline groove toothing. An annular damping element 25 is arranged between the drill drive with the transmission 15 and the upper end of the drill pipes 12. The annular damping element 25 can have a disk spring assembly 26, as schematically indicated in FIG. 2. This can provide at least largely an oscillation/impact decoupling between the drill pipes 12 and the drill drive.

In the assembly according to the invention, the control unit 30 can ensure, in particular when pulling the drill pipes 12 out of the borehole, in a schematically indicated soil, that no impact pulses are exerted on the drill pipes during the pulling movement. This is particularly gentle on the illustrated damping element 25, which is susceptible to impact pulses during the pulling movement. This can significantly extend the service life of the damping element.

The invention claimed is:

1. A device for generating oscillations for a construction machine, comprising a housing, a piston which is movable back and forth in a working chamber in the housing between a first return point and a second return point, a pressurized fluid supply by means of which in each case pressurized fluid can be fed into and discharged from the working chamber via at least one actuatable control valve in the region of the first return point and/or the second return point, wherein the piston can be set into a reciprocating motion in order to generate the oscillations, and a control unit which is configured to actuate the at least one control valve and by means of which the motion of the piston in the working chamber is controllable and variable, wherein the control unit is configured to actuate the piston in a first operating mode for generating oscillations and in a second operating mode for generating impact pulses, wherein a strike surface is formed on at least one end side of the working chamber, onto which surface the piston strikes when it reaches at least one return point in order to generate an impact pulse.

2. The device according to claim 1, wherein the control valve is configured as a solenoid valve.

3. The device according to claim 1, wherein a measuring device is provided for determining a position of the piston in the working chamber.

4. The device according to claim 3, wherein the measuring device comprises a linear sensor.

5. The device according to claim 1, wherein a frequency and/or a stroke of the piston can be set and adjusted by means of the control unit.

6. The device according to claim 1, wherein the control unit comprises a program memory in which control programs for controlling the piston can be stored.

7. The device according to claim 1, wherein the control unit comprises a selection device by means of which an operating mode can be selected by an operator manually and/or automatically from a detected operating state.

8. The device according to claim 1, wherein the working chamber is formed with two end sides each having one strike surface, onto which the piston alternately strikes in order to generate impact pulses.

9. A construction machine, wherein a device for generating oscillations and impact pulses according to claim 1 is arranged.

10. The construction machine according to claim 9, wherein this machine is configured as a drilling rig for earth and/or rock drilling.

11. The construction machine according to claim 9, wherein the device for generating oscillations and impact pulses is arranged on a rotary drive for rotationally driving a drilling tool, and a damping element is arranged between the rotary drive and the drilling tool or drill pipes.

12. A method of operating a device according to claim 1, in which a piston is moved back and forth in a working chamber in a reversing manner between a first return point and a second return point, wherein the piston is set into a reciprocating motion by means of a pressurized fluid and at least one actuatable control valve, in order to generate the oscillations, and the pressurized fluid is introduced into and discharged from the working chamber in the region of the first return point and/or the second return point, and the at least one control valve is actuated by means of a control unit, wherein the movement of the piston in the working chamber is controllable and variable, wherein the control unit is configured to actuate the piston in a first operating mode for generating oscillations and in a second operating mode for generating impact pulses, wherein a strike surface is formed on at least one end side of the working chamber, onto which surface the piston strikes when it reaches at least one return point in the second operating mode, in order to generate an impact pulse.

13. The method according to claim 12, wherein an operating mode is selected and set by means of a selection device.

14. The method according to claim 12, wherein the device for generating oscillations and impact pulses is used on a drilling rig with a drilling tool which can be driven in rotation, the device is operated in the second operating mode during sinking-by-drilling a borehole into soil or rock, wherein impact pulses are exerted on the drilling tool, and the device is operated in the first operating mode when the drill pipes are pulled out of the borehole, wherein the drilling tool is induced to oscillate.

15. The method according to claim 12, wherein an operating state, in particular a sinking-by-drilling or a pulling of a drilling tool in a drilling rig, is detected by means of at least one detection device, and an operating mode is automatically selected and set by the selection device depending on the detected operating state.

* * * * *